US006131619A

United States Patent [19]

Faasse et al.

[11] Patent Number: 6,131,619

[45] Date of Patent: Oct. 17, 2000

[54] HARNESS FRAME WITH HEDDLE ROD SLIDE MEMBER

[75] Inventors: Gene E. Faasse, Taylors; Michael T. King, Williamston, both of S.C.

[73] Assignee: Steel Heddle Manufacturing Company, Greenville, S.C.

[21] Appl. No.: 09/363,467

[22] Filed: Jul. 29, 1999

[51] Int. Cl.[7] ..... D03C 9/06

[52] U.S. Cl. ..... 139/92

[58] Field of Search ..... 139/92

[56] References Cited

U.S. PATENT DOCUMENTS

| | | | |
|---|---|---|---|
| 2,560,512 | 7/1951 | Kaufamnn | 139/92 |
| 2,614,586 | 10/1952 | Kaufmann | 139/92 |
| 2,896,672 | 7/1959 | Kaufmann | 139/92 |
| 3,209,788 | 10/1965 | Kaufmann | 139/92 |
| 3,221,777 | 12/1965 | Koch | 139/92 |
| 4,252,153 | 2/1981 | Kaufmann et al. | 139/92 |

*Primary Examiner*—Andy Falik
*Attorney, Agent, or Firm*—Dority & Manning

[57] ABSTRACT

A harness frame for use in weaving machines includes a generally rectangular frame formed by top and bottom slats attached to side members. Heddle rods are carried by the slats wherein heddles are placeable onto or removable from at least one end of the heddle rods. A slide member is disposed on the side member adjacent at least one of the heddle rods. The slide member is movable on the side member between an open position wherein the slide member is displaced from the heddle rod so that the heddles can be slid on or off of the heddle rod, and a closed position wherein the slide member abuts against,the heddle rod and prevents heddles from being slid off of the heddle rod.

17 Claims, 5 Drawing Sheets

HARNESS FRAME WITH HEDDLE ROD SLIDE MEMBER

BACKGROUND OF THE INVENTION

The present invention relates to harness frames in general, and more particularly to a harness frame having a mechanism allowing for the addition or removal of heddles to the heddle rods of the harness frame in a simple manner.

Various types of heddle retaining devices are known in the art for maintaining heddles on the heddle rods of harness frames. For example, U.S. Pat. No. 2,614,586 describes a pivotally mounted device having a prong that engages in an aperture defined in the heddle rod. This device serves to stress the heddle rod and also to maintain the end of the heddle rod in a recess or slot formed in the side member or strut.

U.S. Pat. No. 2,896,672 describes a supporting and securing device for tensioning and securing the heddle rods. Each securing device is attached to a side strut of the frame and has a projecting member that extends into an aperture defined in the heddle rod. When the securing member is in its operative position, it maintains the heddle rod in a taunt or stressed condition. When it is desired to disconnect one end of the heddle rod for the purpose of removing or adding heddles, the securing member is disengaged from the heddle rod.

U.S. Pat. No. 2,560,512 discloses a similar device wherein a spring member is pivotally secured to the side struts. The spring member has a recess formed on its end in which/the end portion of the heddle rod is seated.

U.S. Pat. No. 3,209,788 describes a device wherein a resilient strip is attached to the top and bottom rails. The free end of the strip is received in a slot or aperture defined in the heddle rod. The ends of the strips can be moved out of the apertures for adding or removing heddles to the rods.

The present invention relates to an improved heddle retaining device that operates without engaging in a hole or aperture defined in the heddle rod.

OBJECTS AND SUMMARY OF THE INVENTION

A principal object of the present invention to provide a harness frame having an improved heddle retaining mechanism.

It is an additional object of the present invention to provide an improved heddle retaining mechanism that can be utilized on any conventional harness frame arrangement.

It is still a further object of the present invention to provide an improved heddle retaining mechanism that is particularly suited for conventional harness frames wherein the heddle rods are riveted or otherwise attached directly to the frame slat.

Additional objects and advantages of the invention will be set forth in part in the following description, or may be obvious from the description, or may be learned through practice of the invention.

In accordance with the objects and purposes of the invention, a harness frame for use in weaving machines is provided. The frame is generally rectangular and formed by generally parallel top and bottom slats attached to opposite side members. An upper heddle rod is carried on the top slat, and a lower heddle rod is carried on the bottom slat for supporting a plurality of heddles in the heddle frame. The general construction of such harness frames is well understood by those skilled in the art.

Heddles can be placed onto or removed from the heddle rods from at least one end of the heddle rods. In this regard, a slide member is disposed on a member of the rectangular frame adjacent to the end of the heddle rod from which the heddles are placed or removed. The slide member is slidably movable between an open position wherein the slide member is displaced from the heddle rod so that heddles can be slid on or off of the heddle rod, and a closed position wherein the slide member abuts against the heddle rod and prevents heddles from being slid off of the heddle rod. In a preferred embodiment, the slide member is slidably disposed on the side member across from the end of the heddle rod. In this embodiment, the slide member may slide longitudinally along the side member between the open and closed positions.

The slide member in the closed position may abut against any surface of the heddle rod. In a particularly preferred embodiment, the slide member in the closed position abuts against either the upper or lower longitudinal edge of the heddle rod depending on placement of the slide member on the heddle frame.

Preferably, the slide member is lockable in at least the closed position, and preferably by an automatic locking mechanism, such as a spring loaded device. For example, the slide member may incorporate a spring loaded section, such as an angled planar section, that spring loads the slide member in the locked position. In an alternative embodiment, the slide member may be locked in position by a spring loaded detent device.

Preferably, the slide member is easily manually operated and includes a manual actuating member, for example disposed at one end of the slide member. In this embodiment, a rod engaging member may be disposed at the opposite end of the slide member. For example, the rod engaging member may simply comprise a transversely extending arm that engages against the longitudinal edge of the heddle rod. Various configurations are obviously within the scope and spirit of the invention in this regard.

The slide member may be slidably disposed on the frame in any number of ways. For example, in a preferred embodiment, the slide member includes at least one elongated slot engaged with a pin member defined on the frame. The elongated slot defines the range of movement of the slide member between the open and closed positions. Preferably, two such pin and slot arrangements are utilized to ensure that the slide member is maintained in longitudinal alignment relative to the harness frame. In this embodiment, one of the pins may also serve as a component of the locking mechanism for maintaining the slide member in the locked position. For example, the slide member may contain a spring loaded or angled section that engages against one of the pins under tension in the closed position of the slide member thereby maintaining the slide member in the closed position.

The invention will be described in greater detail below through use of the figures.

DETAILED DESCRIPTION

Figure 1:
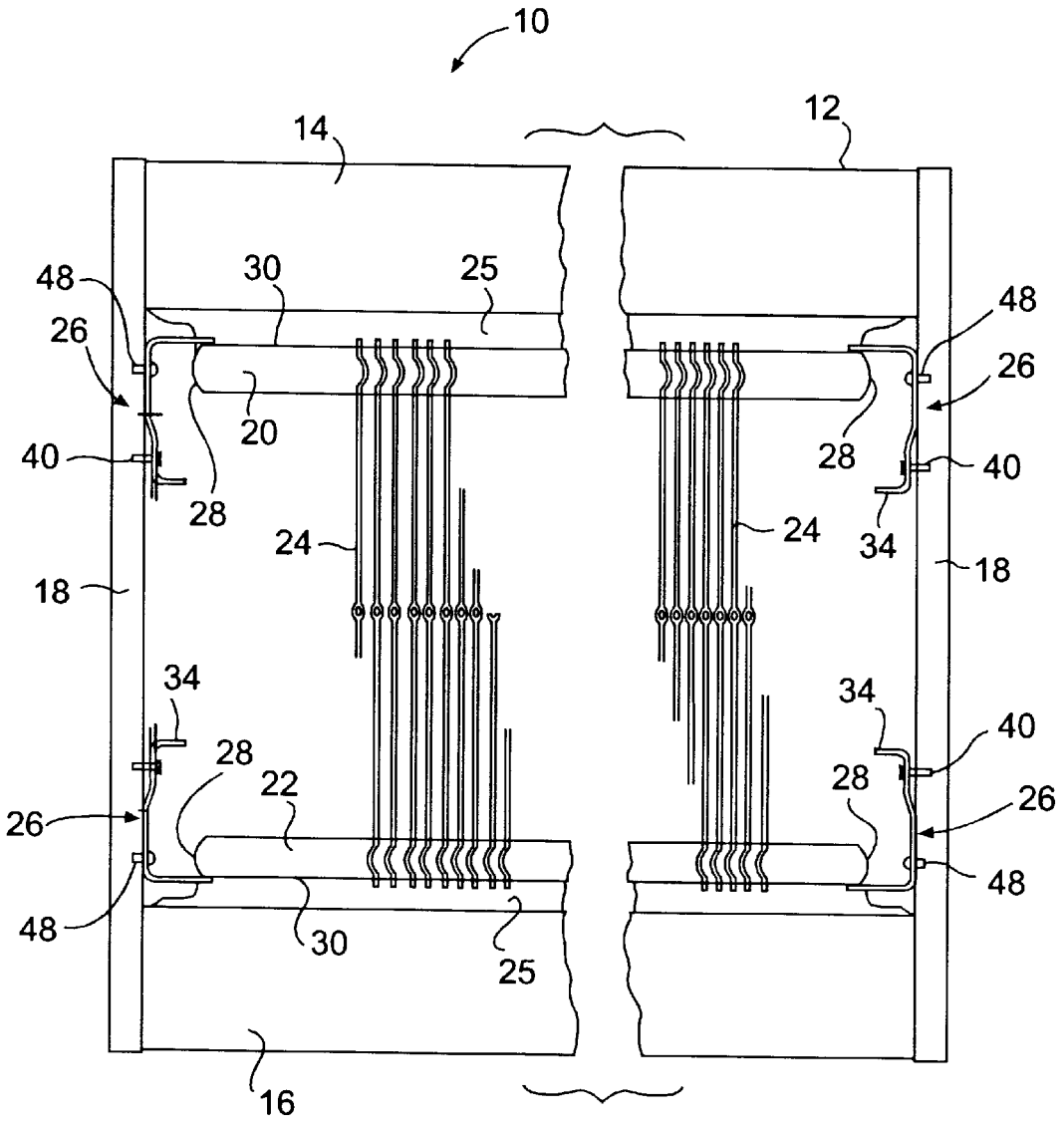
FIG. 1 is a perspective view of a conventional harness frame incorporating the present inventive heddle retention slide members.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

A conventional harness frame is illustrated in FIG. 1. Harness frame 10 includes a generally rectangular frame 12. Frame 12 includes a top slat 14 and a bottom slat 16 connected by side members 18. Upper and lower heddle rods 20, 22, respectively, are attached to the upper and lower slats. In the embodiment of the harness frame illustrated in the figures, the heddle rods 20, 22, are attached directly to a flange 25 formed integral with slats 14, 16. For example, the heddle rods 20, 22 may be attached at various spaced apart locations along flange 25. Typically, rivets are used to attach the heddle rods to flange 25. Another well known device or arrangement for attaching heddle rods 20, 22 to their respective slats is to use a rod support attached to the slat. Typically, these rod supports are formed of a plastic material and are rigidly held in the slat. Rivets or other devices are used to attach the heddle rod to the rod support.

The description of the harness frame of FIG. 1 thus far relates to a conventional harness frame. Various other embodiments of conventional harness frames are well known to those skilled in the art and a detailed explanation of such conventional harness frames is not necessary for an understanding of the present invention. However, it should be appreciated that the present invention is applicable to any such harness frame configuration utilizing heddle rods for supporting heddles on the frame.

The plurality of heddles 24 are slidably supported on heddle rods 20, 22. Heddles 24 may be of any conventional configuration, such as flat steel heddles and round wire heddles. Also, the heddles may incorporate any conventional end configuration for being held on the heddle rods, including C-shaped slots, J-shaped slots, and 0-shaped slots. Again, the invention is not limited to any particular heddle configuration.

The present invention includes at least one slide member, generally 26, that may be disposed on at least one side member 18 adjacent to an end 28 of one of the heddle rods 20, 22. In a preferred embodiment as illustrated in FIG. 1, a slide member 26 is disposed at each end 28 of each heddle rod 20, 22. However, this is not a requirement of the invention. For example, each heddle rod 20 may only include one slide member 26 disposed at one end 28 thereof.

Figure 2:
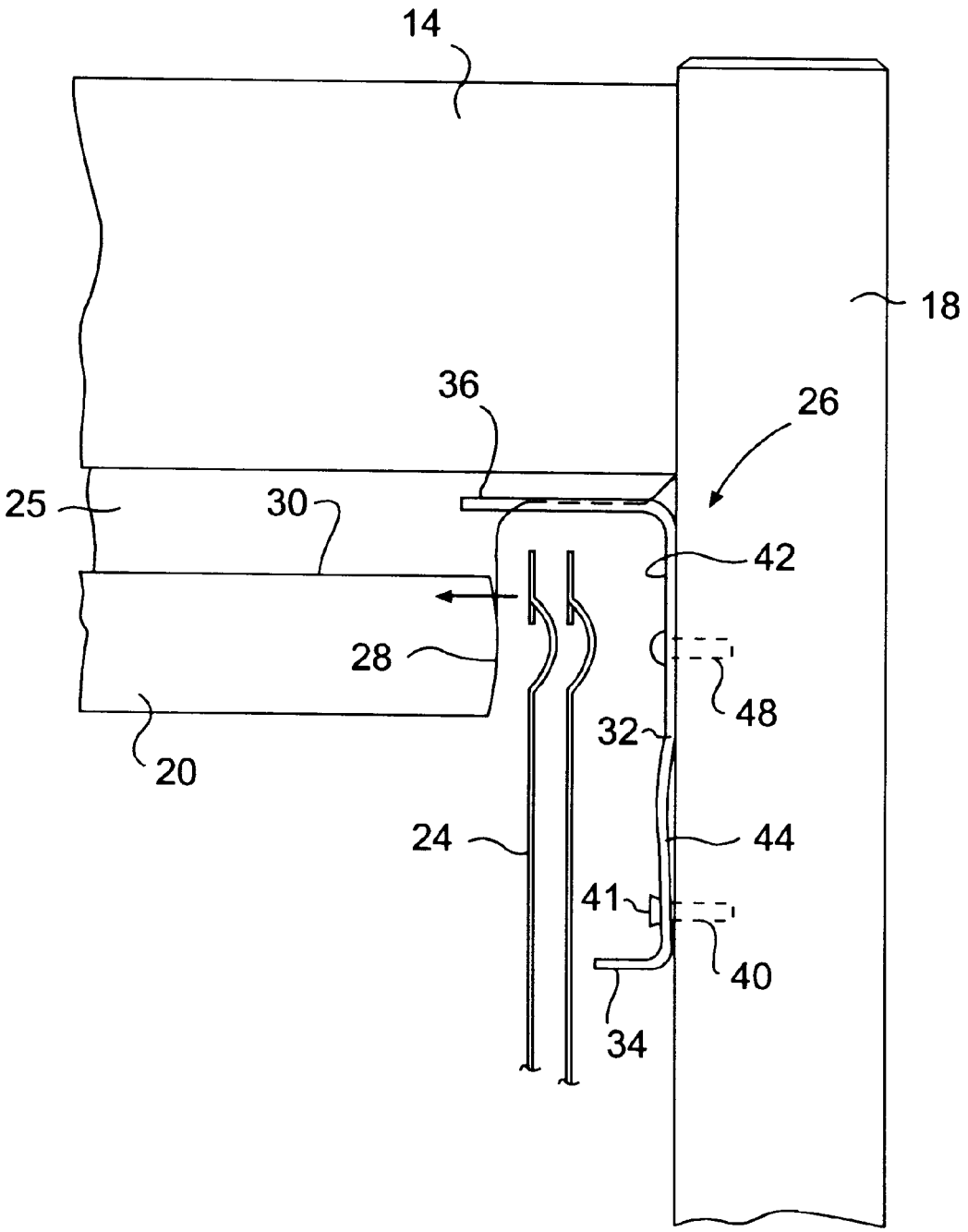
FIG. 2 is an enlarged perspective view of one of the slide members in the open position.
Figure 3:
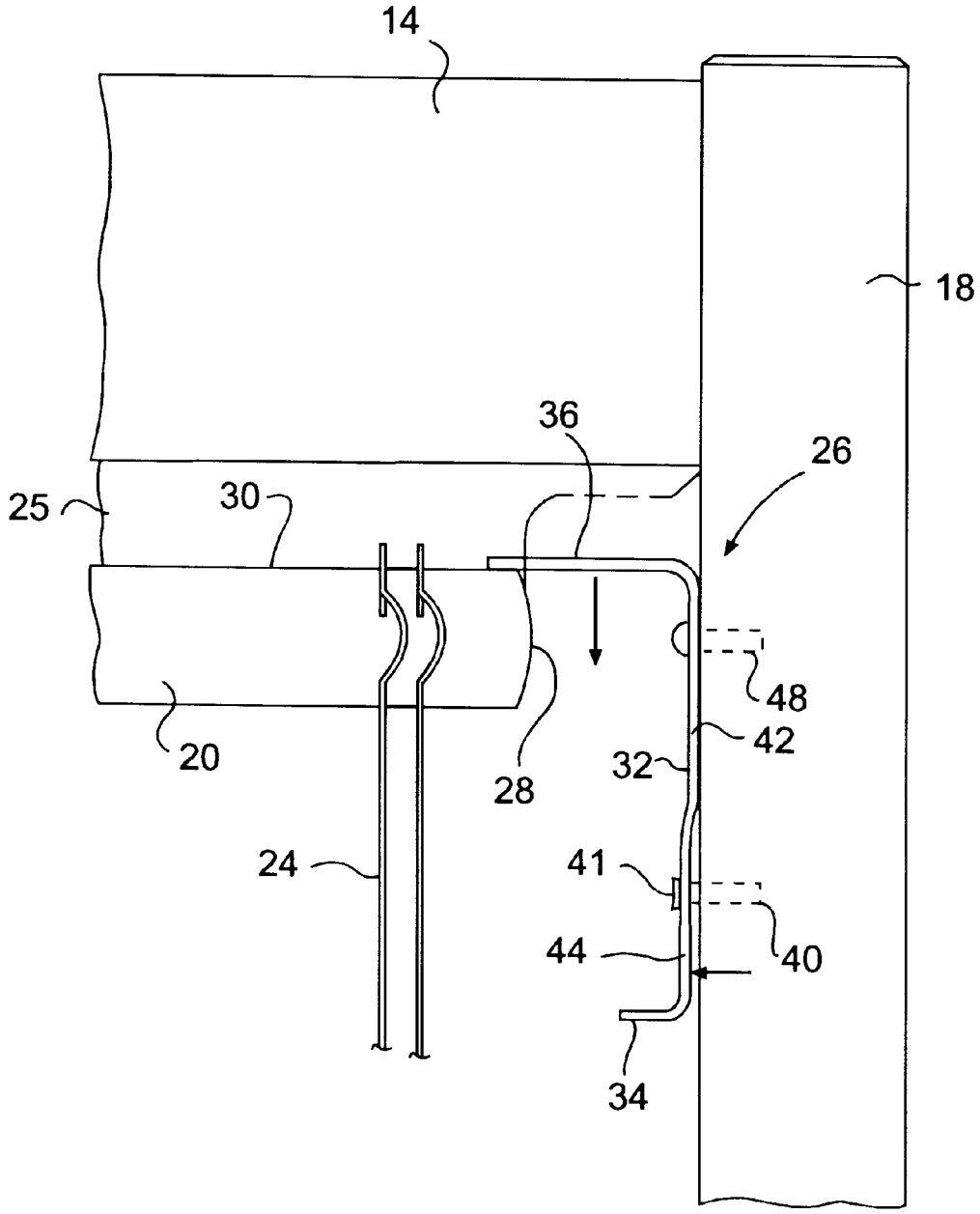
FIG. 3 is a perspective view according to FIG. 2 particularly illustrating the slid member in the closed position.
Figure 4:
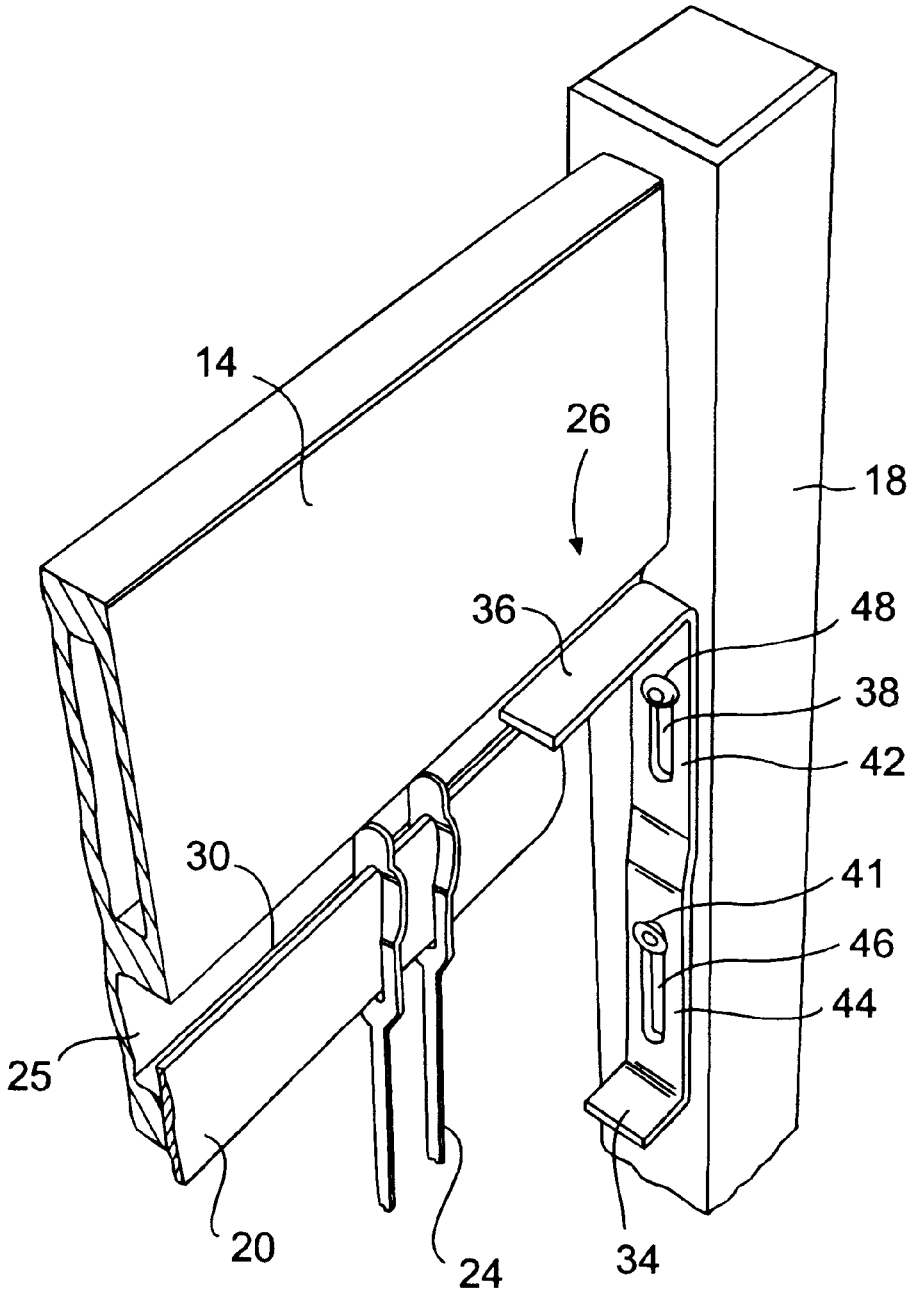
FIG. 4 is an additional perspective view of the slide member.
Figure 5:
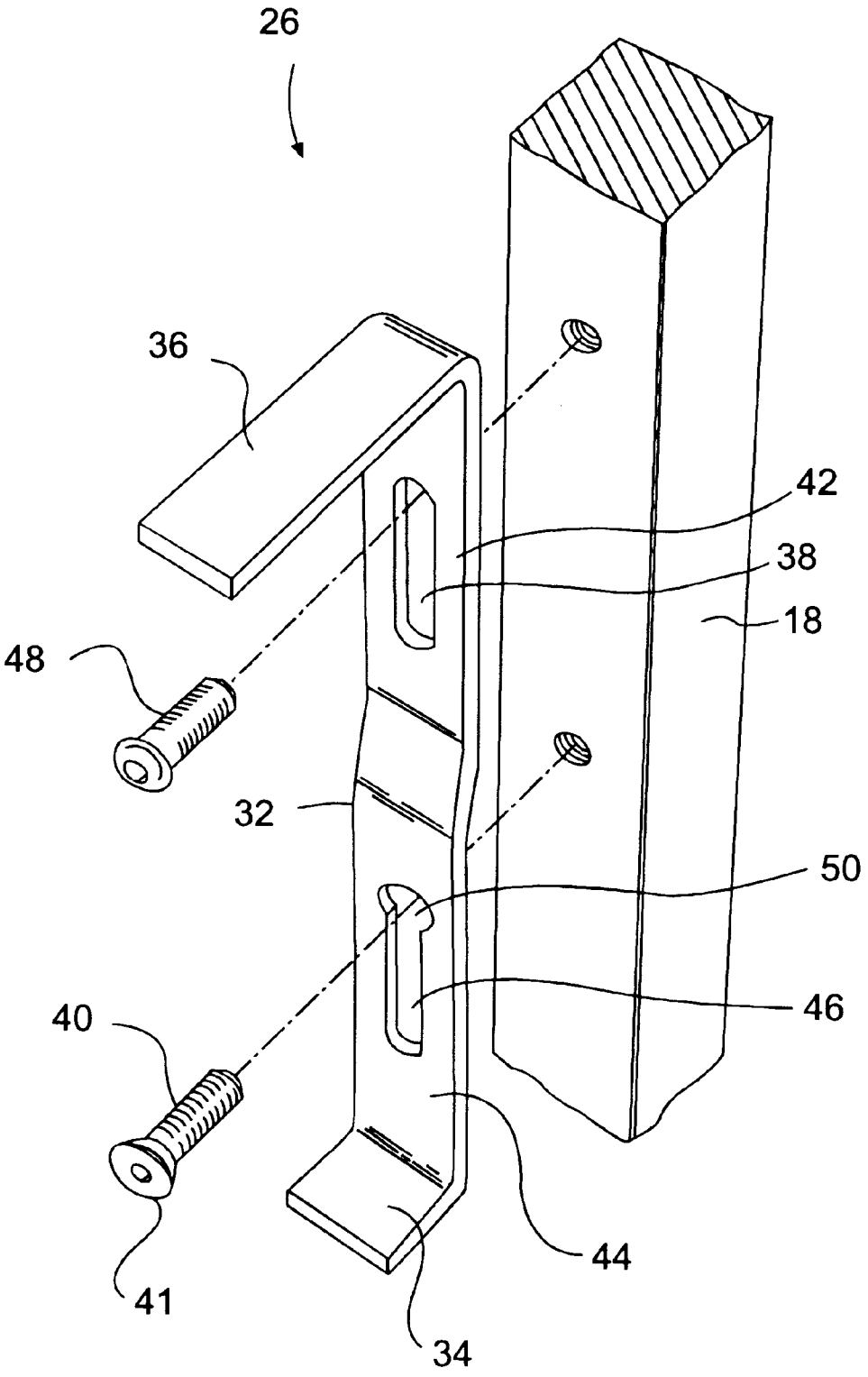
FIG. 5 is a component view of the slide member according to the invention.

Slide member 26 is movable between an open position, as illustrated in FIG. 2, and a closed position as illustrated in FIG. 3. In the open position illustrated in FIG. 2, slide member 26 is displaced from heddle rod 20 so that heddles 24 can be slid onto or off of heddle rod 20 at its end 28. In the closed position illustrated in FIG. 3, the heddles 24 are prevented from sliding off of heddle rod 20.

Slide member 26 can take on any number of physical configurations. In a preferred embodiment illustrated in the figures, slide member 26 includes a base member 32 that is slidably disposed against an inner longitudinal face of side member 18. In order to easily slide base member 32, a manual actuating member, such as a transverse arm 34, is defined at one end of the base member 32. A heddle rod engaging member 36 may be defined at the opposite end of base member 32. Heddle rod engaging member 36 may comprise a simple transverse arm extending from base 32.

In a preferred embodiment illustrated in the figures, heddle rod engaging member 36, in its closed position, abuts against a longitudinal upper edge 30 of heddle rod 20, as particularly seen in FIG. 3. It should be appreciated that heddle rod engaging member 36 and manual actuating member 34 can take on a number of various forms.

Slide member 26 may be slidably disposed against side member 18 in a number of ways. In the embodiment illustrated, longitudinal slots 38, 46, are defined in base member 32. These slots engage with pin members 48, 40 respectively. The length of the slots define the range of movement of base member 32 along side member 18.

It may also be preferred that base member 32 of the slide member is lockable in position, particularly the closed position illustrated in FIG. 3. Various mechanisms may be utilized in this regard. In the embodiment illustrated, base member 32 includes a first planar section 42 that is slidably disposed directly against the inner longitudinal edge of side member 18. Base member 32 includes a second spring or angled section 44 that is spaced apart from side member 18, as particularly illustrated in FIGS. 2 and 3. Slot 46 defined in this spring section 44 includes an enlarged section 50 at the end thereof. Pin member 40 has a head 41 that will drop into the enlarged section 50 when the slide member is slid into the closed position, as particularly illustrated in FIG. 3. This mechanism thus essentially locks the mechanism in the closed position. In order to move the slide member 26 into the open position of FIG. 2, the operator must grasp manual actuating member 34 and push the slide member towards side member 18 and upwards at the same time into the position illustrated in FIG. 2. Thus, it should be appreciated that the slide member is positively maintained in the closed position so that during normal operating conditions of the harness frame, the slide member will not inadvertently open. Due to the resiliency of spring section 44, the slide member will automatically lock upon the device being positioned such that head 41 of pin member 40 comes into alignment with enlarged section 50 of slot 46.

It should also be appreciated that the slide member 26 may be disposed in positions other than that illustrated in the figures. For example, the slide member 26 may be positioned longitudinally along side member 18 such that heddle rod engaging member 36 abuts against the inner longitudinal face of the heddle rods.

It should be appreciated by those skilled in the art that various modifications and variations can be made in the present invention without departing from the scope and spirit of the invention. For example, the slide member may take on any physical configuration. Additionally, the slide member may be slidably disposed relative to the side member in any number of ways. It is intended that the present invention include such modifications and variations as come within the scope of the appended claims and their equivalents.

What is claimed is:

1. A harness frame for use in weaving machines, said harness frame comprising:

a generally rectangular frame formed by generally parallel top and bottom slats attached to side members;

an upper heddle rod operatively configured with said top slat so as to be supported within said frame by said top slat, and a lower heddle rod operatively configured with said bottom slat so as to be supported within said frame by said bottom slat, said heddle rods for supporting a plurality of heddles in said heddle frame, wherein heddles are placeable onto or removable from at least one end of said heddle rods; and at least one slide member disposed on said side member adjacent one of said ends of said heddle rods, said slide member movable on said side member between an open position wherein said slide member is displaced from said heddle rod so that heddles can be slid on or off of said heddle rod, and a closed position wherein said slide member abuts against said heddle rod and prevents heddles from being slid off of said heddle rod, in said closed position said slide member being in non-supporting contact with said heddle rod such that securement of said heddle rod within said frame is not dependent on a position of said slide member.

2. The harness frame as in claim 1, comprising at least one said slide member disposed adjacent at least one said end of each said heddle rod.

3. The harness frame as in claim 1, wherein said slide member in said closed position abuts against a longitudinal edge of said heddle rod.

4. A harness frame for use in weaving machines, said harness frame comprising:

a generally rectangular frame formed by generally parallel top and bottom slats attached to side members;

an upper heddle rod carried on said top slat, and a lower heddle rod carried on said bottom slat for supporting a plurality of heddles in said heddle frame, wherein heddles are placeable onto or removable from at least one end of said heddle rods: and at least one slide member disposed on said side member adjacent one of said ends of said heddle rods, said slide member movable on said side member between an open position wherein said slide member is displaced from said heddle rod so that heddles can be slid on or off of said heddle rod, and a closed position wherein said slide member abuts against said heddle rod and prevents heddles from being slid off of said heddle rod; and wherein said slide member slides longitudinally along said side member between said open and closed positions.

5. The harness frame as in claim 1, wherein said slide member is lockable in said closed position.

6. The harness frame as in claim 1, wherein said slide member comprises an elongated base member having a manual actuating member at one end and a heddle rod engaging member at an opposite end thereof.

7. The harness frame as in claim 6, wherein said heddle engaging member extends generally transversely from said base member and engages against an outer longitudinal edge of said heddle rod, said heddle engaging member thereby movable between said outer longitudinal edge and said respective slat.

8. The harness frame as in claim 6, wherein said base member comprises at least one elongated slot engaging with a pin member fixed to said respective side member, said slot defining a range of movement of said slide member between said open and closed positions.

9. The harness frame as in claim 6, wherein said base member comprises a first planar section disposed to slide against said side member and a second spring section that is spaced from said respective side member, said base member further comprising an elongated slot in each of said planar section and said spring section engaging with pin member fixed to said side member.

10. A harness frame for use in weaving machines, said heddle frame comprising:

a generally rectangular frame formed by generally parallel top and bottom slats attached to side members;

an upper heddle rod carried on said top slat, and a lower heddle rod carried on said bottom slat for supporting a plurality of heddles in said heddle frame, wherein heddles are placeable onto or removable from at least one end of said heddle rods; and a slide member disposed on said rectangular frame adjacent said end of said heddle rod, said slide member movable between an open position wherein said slide member is displaced from said heddle rod so that heddles can be slid on or off of said heddle rod, and a closed position wherein said slide member abuts against said heddle rod and prevents heddles from being slid off of said heddle rod.

11. The harness frame as in claim 10, wherein said slide member is slidably disposed on said side member across from said end of said heddle rod.

12. A harness frame for use in weaving machines, said heddle frame comprising:

a generally rectangular frame formed by generally parallel top and bottom slats attached to side members;

an upper heddle rod carried on said top slat, and a lower heddle rod carried on said bottom slat for supporting a plurality of heddles in said heddle frame, wherein heddles are placeable onto or removable from at least one end of said heddle rods; and a slide member disposed on said rectangular frame adjacent said end of said heddle rod, said slide member movable between an open position wherein said slide member is displaced from said heddle rod so that heddles can be slid on or off of said heddle rod, and a closed position wherein said slide member abuts against said heddle rod and prevents heddles from being slid off of said heddle rod; and wherein said slide member slides longitudinally along said rectangular frame between said open and closed positions.

13. The harness frame as in claim 10, wherein said slide member is spring loaded to lock into said closed position.

14. The harness frame as in claim 10, further comprising an automatic locking mechanism to lock said slide member in said closed position.

15. The harness frame as in claim 10, wherein said slide member comprises an elongated base member having a manual actuating member at one end and a heddle rod engaging member at an opposite end thereof.

16. The harness frame as in claim 15, wherein said heddle engaging member extends generally transversely from said base member and engages against an outer longitudinal edge of said heddle rod, said heddle engaging member thereby movable between said outer longitudinal edge and said respective slat.

17. The harness frame as in claim 15, wherein said base member comprises at least one elongated slot engaging with a pin member fixed to said respective side member, said slot defining a range of movement of said slide member between said open and closed positions.

* * * * *